US012458859B2

(12) United States Patent
Candelaria

(10) Patent No.: US 12,458,859 B2
(45) Date of Patent: Nov. 4, 2025

(54) PORTABLE SPARRING MANNEQUIN DEVICE

(71) Applicant: Dexter Candelaria, Laramie, WY (US)

(72) Inventor: Dexter Candelaria, Laramie, WY (US)

( * ) Notice: Subject to any disclaimer, the term of this patent is extended or adjusted under 35 U.S.C. 154(b) by 203 days.

(21) Appl. No.: 18/234,599

(22) Filed: Aug. 16, 2023

(65) Prior Publication Data

US 2025/0058194 A1 Feb. 20, 2025

(51) Int. Cl.
*A63B 69/20* (2006.01)
*A63B 69/26* (2006.01)

(52) U.S. Cl.
CPC ..... *A63B 69/215* (2022.08); *A63B 69/26* (2013.01); *A63B 2225/09* (2013.01)

(58) Field of Classification Search
CPC ... A63B 69/215; A63B 69/26; A63B 2225/09; A63B 69/34
See application file for complete search history.

(56) References Cited

U.S. PATENT DOCUMENTS 4,546,966 A * 10/1985 Segura ..... A63B 69/26 482/88
5,281,191 A * 1/1994 DeSousa ..... A63B 69/305 473/442
D440,269 S 4/2001 Thomas
7,214,169 B1 5/2007 Clayton
9,999,819 B2 * 6/2018 DeLaRosa ..... A63B 69/215
10,709,951 B2 7/2020 Khan
2013/0296141 A1 * 11/2013 Partlo ..... A63B 69/32 482/84
2015/0057131 A1 * 2/2015 Manley ..... A63B 69/26 482/83
2015/0209642 A1 * 7/2015 Winter ..... A63B 69/002 482/83
2019/0388755 A1 12/2019 Hall
2020/0038730 A1 * 2/2020 Khan ..... A63B 69/26
2022/0280853 A1 * 9/2022 Wilson ..... A63B 69/34
2022/0288440 A1 * 9/2022 Bassoo ..... A63B 21/4037
2022/0362649 A1 * 11/2022 Lee ..... A63B 69/215

FOREIGN PATENT DOCUMENTS

WO WO9956835 11/1999

* cited by examiner

*Primary Examiner* — Andrew M Kobylarz

(57) ABSTRACT

A portable sparring mannequin device for realistic fighting training includes a dummy with head, neck, and torso portions. The dummy also has a front side and a back side. A cushioning panel is attached to the back side. A harness is coupled to the torso portion for releasably attaching the dummy to a user. The harness comprises a plurality of straps having adjustable lengths and being releasably coupled to each other. The neck portion is angled forwardly such that the head portion is positioned forwardly relative to the torso portion. A first and second arm rod may be removably attached to the harness or the torso portion. The first and second arm rods each include a pole, with a boxing glove attached to one end and padding extending along the pole from the boxing glove toward the other end. A counterweight may be removably attached to the other end.

11 Claims, 12 Drawing Sheets

PORTABLE SPARRING MANNEQUIN DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sparring dummies and more particularly pertains to a new sparring dummy for realistic fighting training.

(2) Description of Related Art Including Information Disclosed Under 37 CFR 1.97 and 1.98

The prior art relates to sparring dummies. The prior art discloses dummies that can be used as punching bags to improve the realism of training exercises. Some such dummies have human-like features, sometimes including faces. Typical prior art devices are designed to stand on a pole or be attached to a punching bag. Some disclosures teach punching bags or sparring dummies attached to springs or other movable stands to enhance dexterity training. Other prior art disclosures include pads and shields that a trainer can wear while practice sparring with a trainee. However, the prior art lacks disclosure of a padded sparring dummy that can move and react with human-like reflexes. The prior art also lacks disclosure of a punching bag or sparring dummy that can strike back toward the user or trainee, thereby teaching and improving defensive techniques. Thus, there is a need in the art for a dummy that can realistically mimic human movement, teaching both offensive and defensive techniques.

BRIEF SUMMARY OF THE INVENTION

An embodiment of the disclosure meets the needs presented above by generally comprising a portable sparring mannequin. The portable sparring mannequin includes a dummy with head, neck, and torso portions. The dummy also has a front side and a back side. A cushioning panel is attached to the back side. A harness is coupled to the torso portion for releasably attaching the dummy to a user. The harness comprises a plurality of straps having adjustable lengths and being releasably coupled to each other. The neck portion is angled forwardly such that the head portion is positioned forwardly relative to the torso portion. A first and second arm rod may be removably attached to the harness or the torso portion. The first and second arm rods each include a pole, with a boxing glove attached to one end and padding extending along the pole from the boxing glove toward the other end. A counterweight may be removably attached to the other end. The user can wear the harness, and the dummy, while practicing fighting or sparring techniques with a trainee. The user is protected from the trainee's blows by the dummy and the cushioning panel. The user can move the dummy with human-like reflexes and can strike back at the trainee using the first and second arm rods. Thus, the trainee receives safe, but highly realistic, training.

There has thus been outlined, rather broadly, the more important features of the disclosure in order that the detailed description thereof that follows may be better understood, and in order that the present contribution to the art may be better appreciated. There are additional features of the disclosure that will be described hereinafter, and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
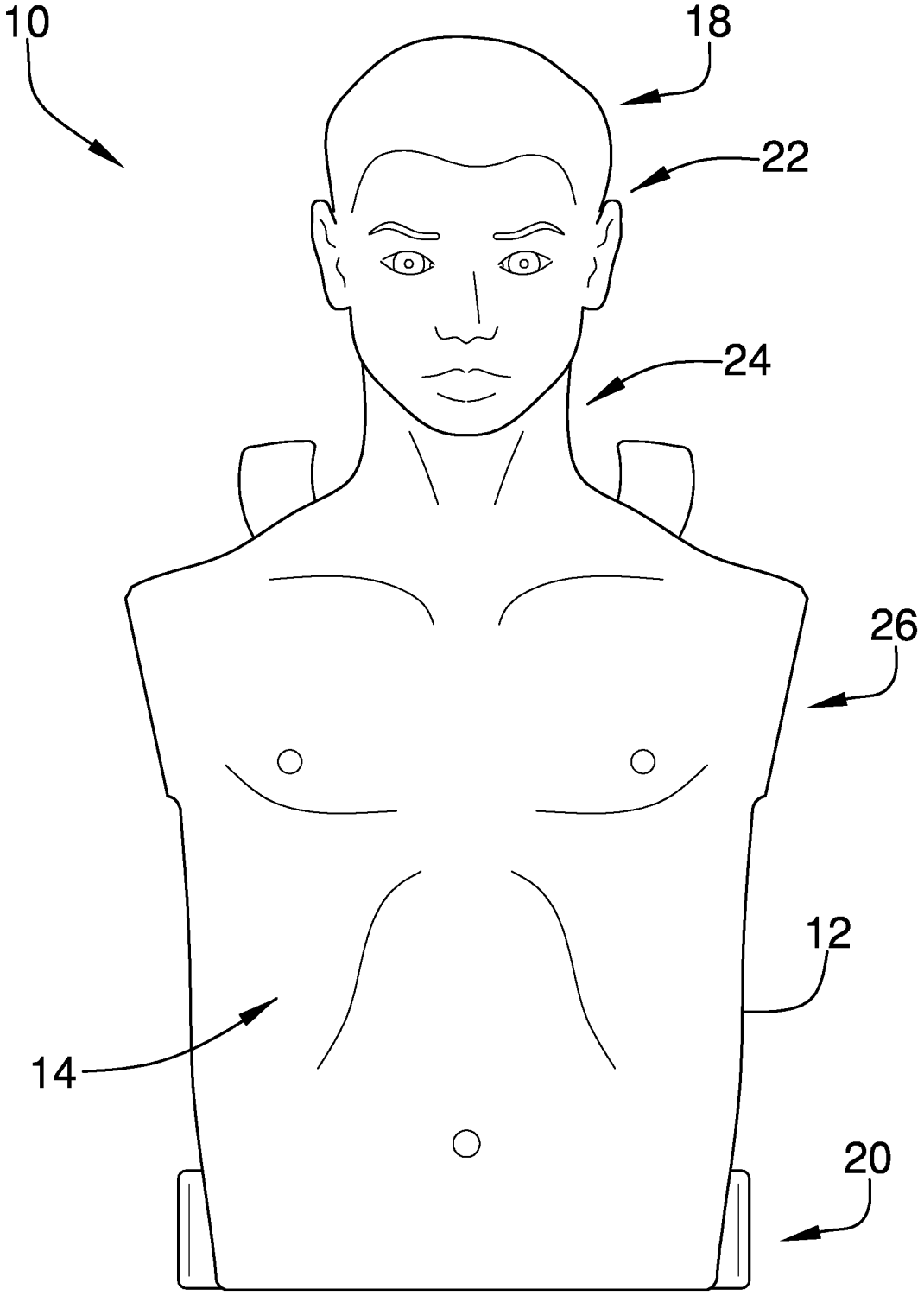
FIG. 1 is a front view of a portable sparring mannequin device according to an embodiment of the disclosure.
Figure 2:
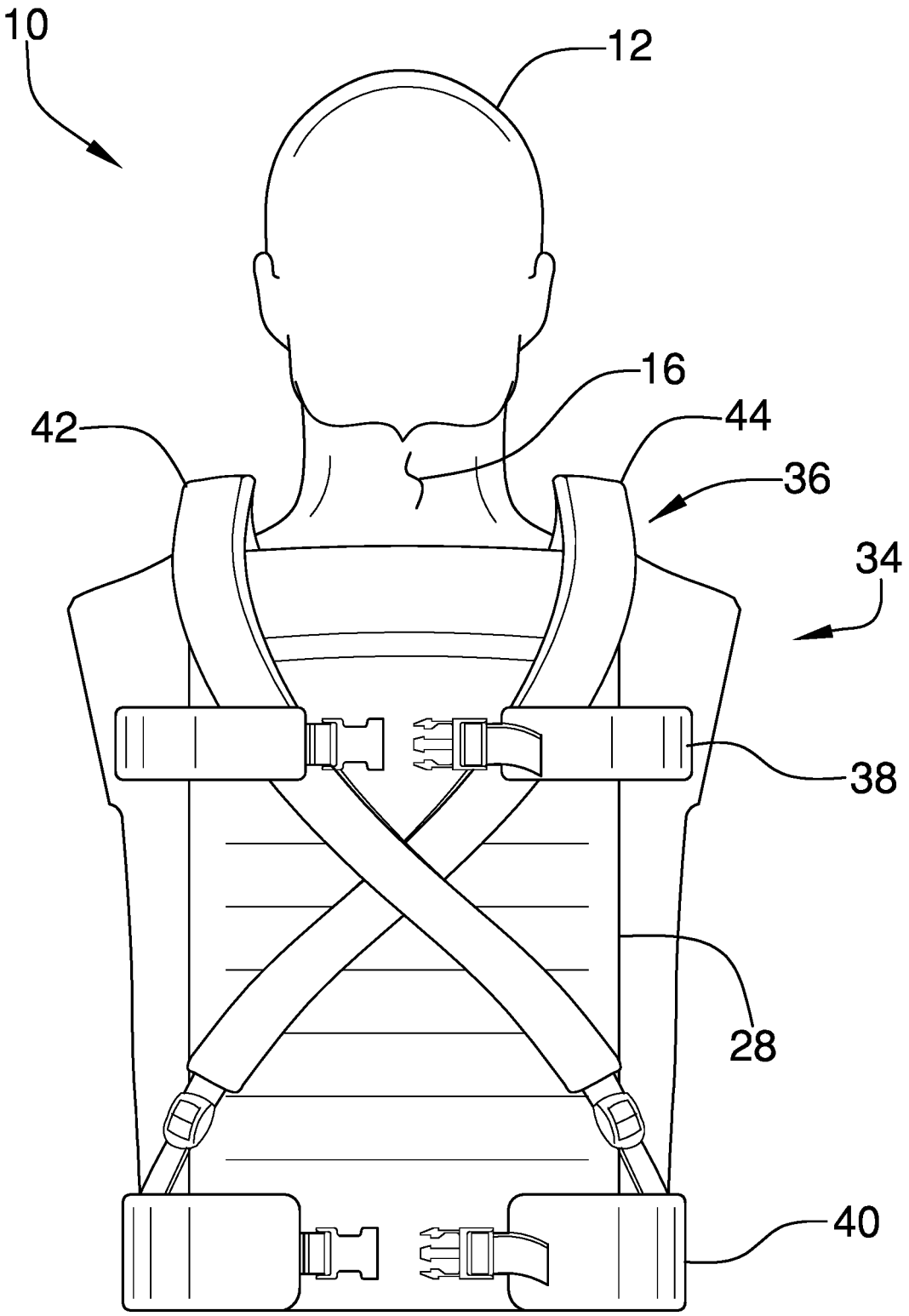
FIG. 2 is a rear view of an embodiment of the disclosure.
Figure 3:
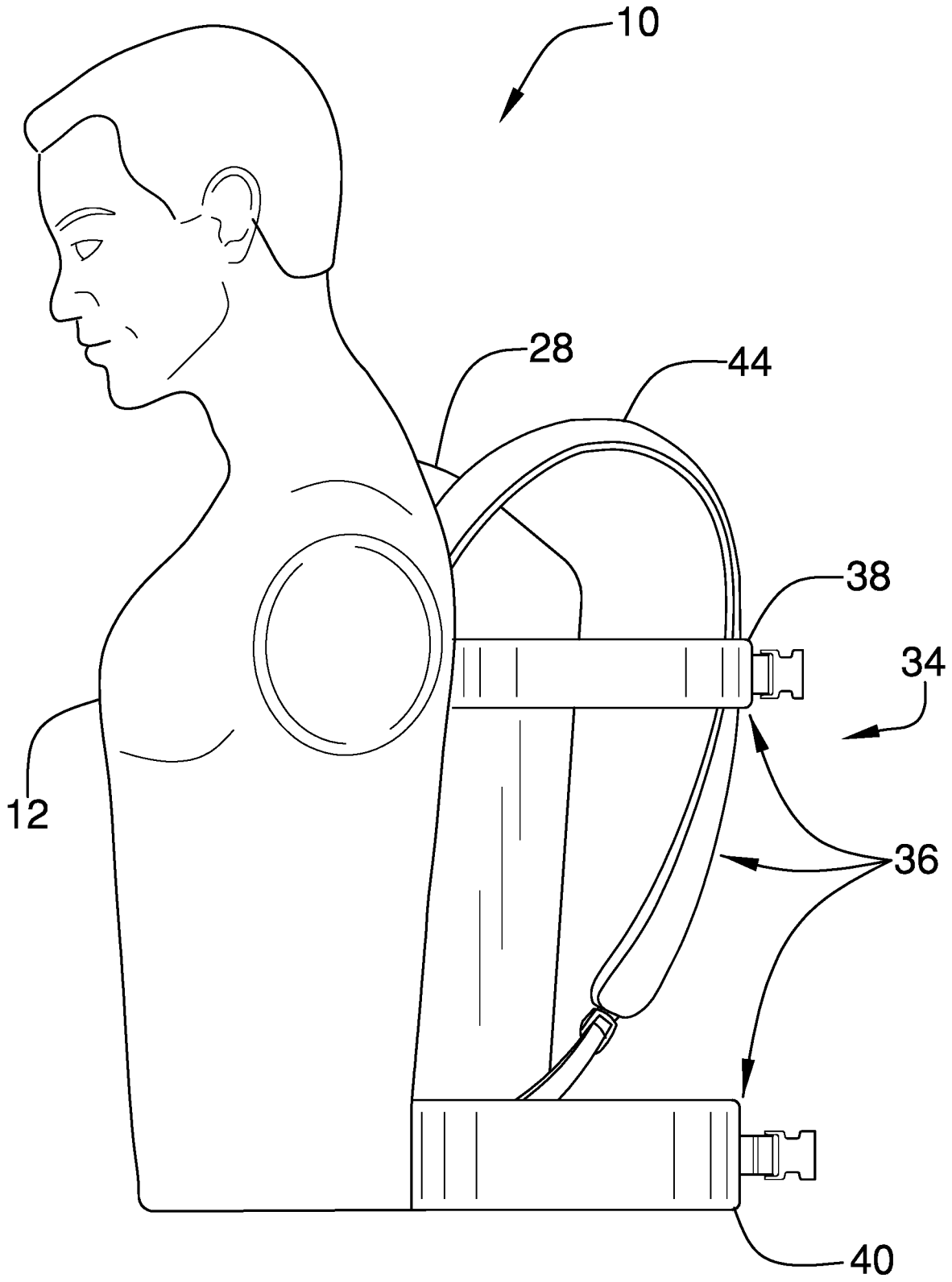
FIG. 3 is a side view of an embodiment of the disclosure.
Figure 4:
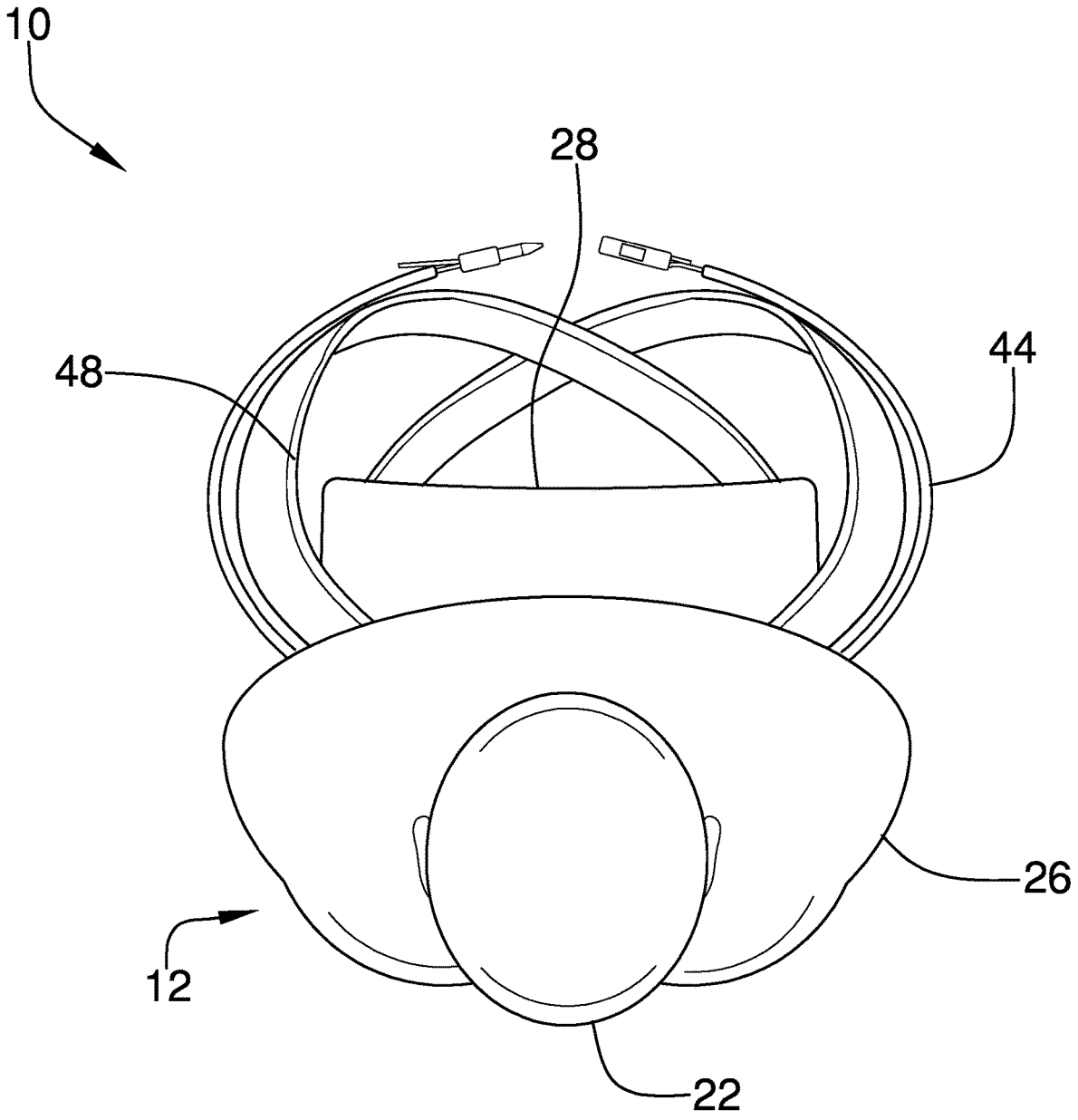
FIG. 4 is a top view of an embodiment of the disclosure.

With reference now to the drawings, and in particular to FIGS. 1 through 10 thereof, a new sparring dummies embodying the principles and concepts of an embodiment of the disclosure and generally designated by the reference numeral 10 will be described.

As best illustrated in FIGS. 1 through 10, the portable sparring mannequin device 10 generally comprises a dummy 12 having a front side 14, a back side 16, a top 18, and a bottom 20. The dummy 12 includes a head portion 22 at the top 18. The head portion 22 is designed to resemble a human head and may include decorative indicium such as hair or facial features. A neck portion 24 extends downwardly from the head portion 22. The neck portion 24 may include decorative indicium resembling features of a human neck. A torso portion 26 extends downwardly from the neck portion 24 to the bottom 20. The neck portion 24 connects the head portion 22 to the torso portion 26. The dummy 12 is configured to receive and withstand strikes and blows from a trainee 72 who is practicing sparring or fighting. The dummy 12 may therefore be formed of a dense foam material encased within a covering material such as simulated silicone skin, natural or synthetic leather, cloth, or plastic. However, other materials may be appropriately used.

Figure 5:
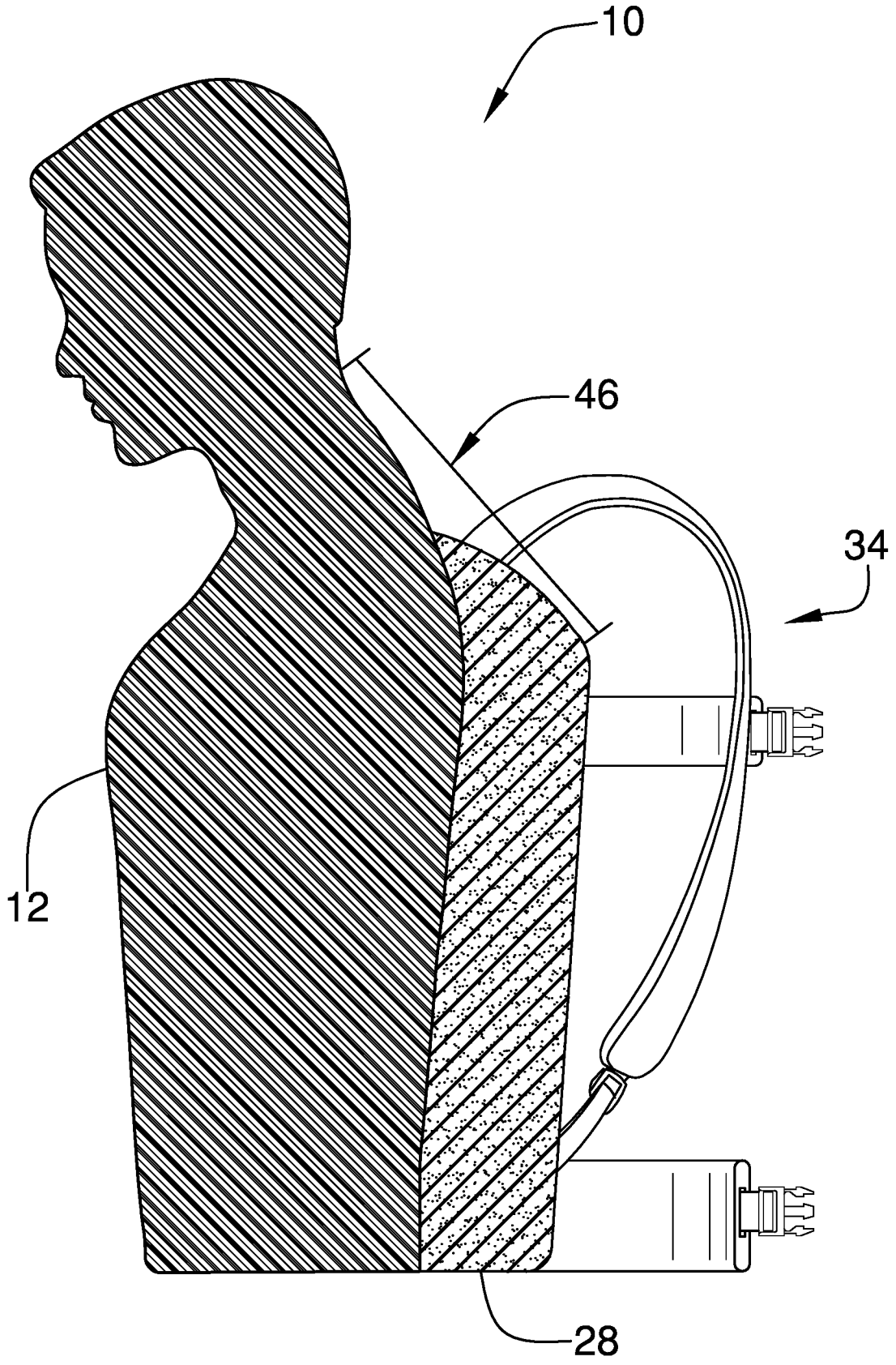
FIG. 5 is a cross sectional view of an embodiment of the disclosure.
Figure 6:
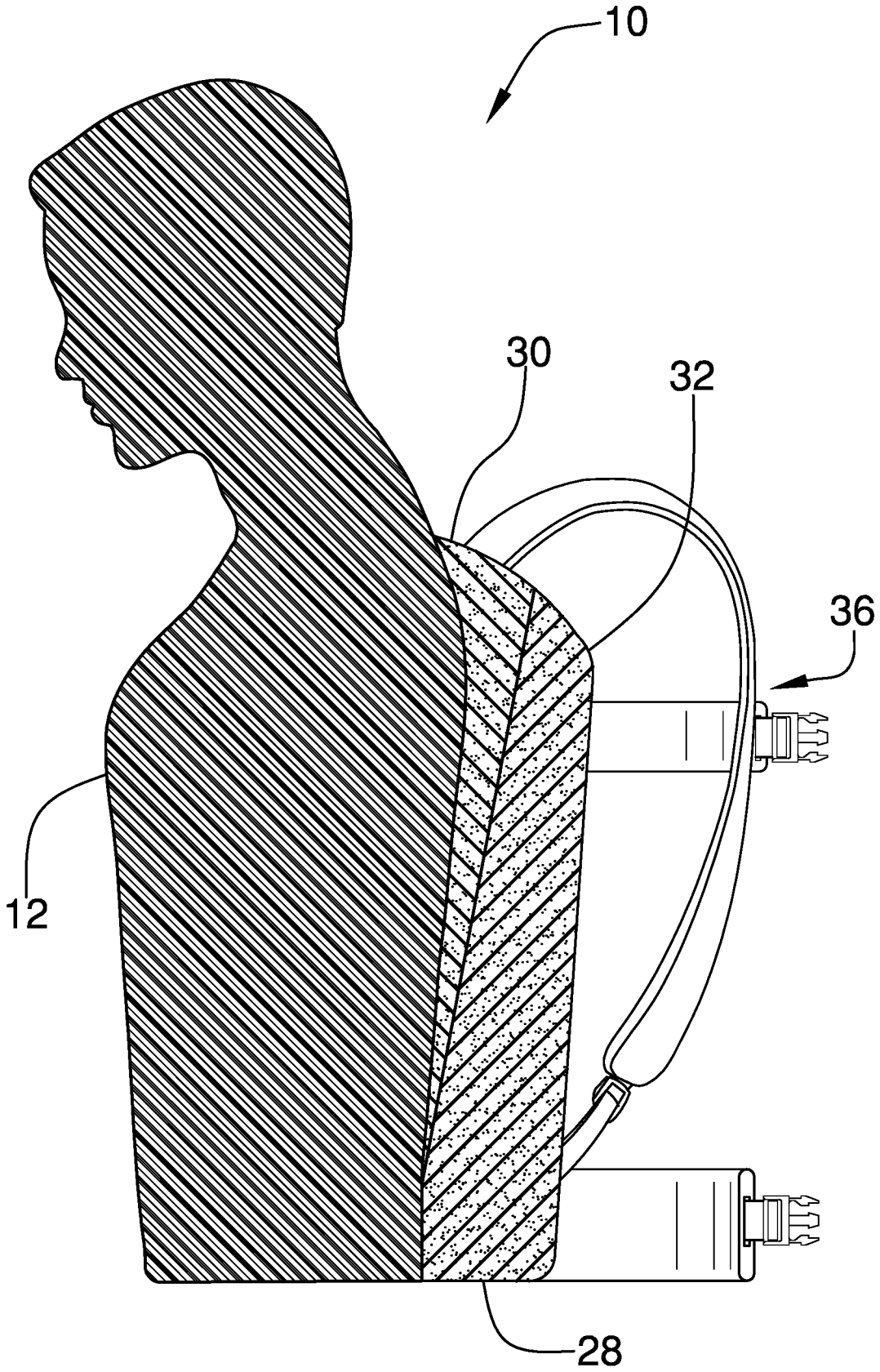
FIG. 6 is a cross sectional view of an embodiment of the disclosure.

A cushioning panel 28 is attached to the back side 16. In some embodiments, as shown in FIG. 5, the cushioning panel 28 may comprise a single layer of padding protruding from the back side 16 along the torso portion 26. Some of those embodiments may comprise a cushioning panel 28 having a single layer of padding and a varying thickness. For example, the padding may be thicker near the top 18, or adjacent to the neck portion 24 than near the bottom 20. In other embodiments, as indicated in FIG. 6, the cushioning panel 28 may have multiple layers. In such embodiments, each of the layers may have a different resistance to compression with respect to each other. For example, a layer closest to the dummy 30 may be more resistant to compression than a layer positioned farthest from the dummy 32. These layers of cushioning material are configured to absorb impacts as a trainee 72 strikes the dummy 12. The cushioning panel 28 thereby protects the user 70 from the force of those impacts, reducing the risk of injury to the user 70.

A harness 34 is coupled to the torso portion 26 for releasably attaching the dummy 12 to the user 70. The harness 34 comprises a plurality of straps 36 having adjustable lengths and being releasably coupled to each other. The plurality of straps 36 are configured to permit the user 70 to adjust the lengths of each of the plurality of straps while the user 70 is wearing the harness 34. The plurality of straps 36 are also configured to permit the user 70 to couple or decouple the plurality of straps 36 while the user 70 is wearing the harness 34. The user 70 can put the harness 34 on or take the harness 34 off themselves, without assistance. The user 70 can also adjust the fit of the harness 34 themselves, while wearing the harness 34.

The plurality of straps 36 may include a chest strap 38 that is configured to receive a chest of the user 70. The chest strap 38 extends horizontally across the back side 16. A waist strap 40 is configured to receive a waist of the user 70. The waist strap 40 extends horizontally across the back side 16 below the chest strap 38. A first shoulder strap 42 and a second shoulder strap 44 are configured to receive a first shoulder and a second shoulder of the user 70. The first shoulder strap 42 and the second shoulder strap 44 extend across the back side 16. The first shoulder strap 42 and the second shoulder strap 44 may over each other between the chest strap 38 and the waist strap 40, forming an x-shape along the back of the user 70.

The harness 34 may be padded. Each of the plurality of straps 36 may be padded, or only some of the plurality of straps 36 may be padded. For example, the first 42 and second 44 shoulder straps may have padding to improve the comfort of the harness 34 for the user 70. In some embodiments, the first 42 and second 44 shoulder straps each include padding that is at least 1.0 inch thick. Each of the plurality of straps 36 may also be formed of a heavy-duty material, such as polyester or nylon, and may be between 2.0 inches and 4.0 inches wide.

The neck portion 24 is angled forwardly such that the head portion 22 is positioned forwardly relative to the torso portion 26. The head portion 22 is thus spaced from the harness 34. For example, the head portion 22 may be spaced vertically and forwardly from the harness 34 such that the head portion 22 is a distance 46 from the harness 34. In some embodiments, the distance 46 is more than 12.0 inches. This mimics a human neck, and also increases the safety of the portable sparring mannequin device 10 for the user 70. For example, when the trainee 72 strikes the head portion 22, the spacing between the head portion 22 and the harness 34 helps minimize risk that the trainee 72 or the head portion 22 will strike the head of the user 70. This can reduce the risk of concussions or other head injuries to the user 70.

Because the dummy 12 and harness 34 are worn by the user 70 for fighting and sparring practice, the dummy 12 and harness 34 should be relatively easy for the user 70 to hold. The user 70 should be able to move easily in the harness 34 while wearing the dummy 12 to mimic an actual fight. For example, the user 70 may want to bob, weave, and perform other tactical offensive and defensive maneuvers while practicing with the trainee 72. Accordingly, the portable sparring mannequin device 10, and particularly the dummy 12, cushioning panel 28, and harness 34 should not be excessively heavy. In some embodiments, the dummy has a weight ranging from 5.0 pounds to 10.0 pounds, so that the user 70 can move around easily and is not too exhausted by holding the dummy 12 to engage in the practice fight.

The portable sparring mannequin device 10 may further comprise a first arm rod 48 and a second arm rod 50. The user 70 can swing and jab at the trainee 72 with the first 48 and second 50 arm rods, imitating a real fight and allowing the trainee 72 to realistically practice their defensive techniques.

Each of the first 48 and second 50 arm rods comprises a pole 52. The pole 52 should be easy for the user 70 to manipulate while wearing the harness 34. For example, the pole 52 may have a length between 2.5 feet and 4.5 feet. The pole 52 may have a diameter that is easily held in the hand of the user 70, for example between 0.5 inch and 2.0 inches.

The pole 52 has a glove end or portion 54 and a gripping portion 58. A boxing glove 68 is attached to the glove end 54. The boxing glove 68 may be permanently affixed to the glove end 54, or it may be removably attached to the glove end 54. A removable boxing glove 68 could be interchanged with differently sized boxing gloves 68, for example ranging in size from 6.0 ounces to 16.0 ounces based on the size or preferences of the user 70.

Figure 7:
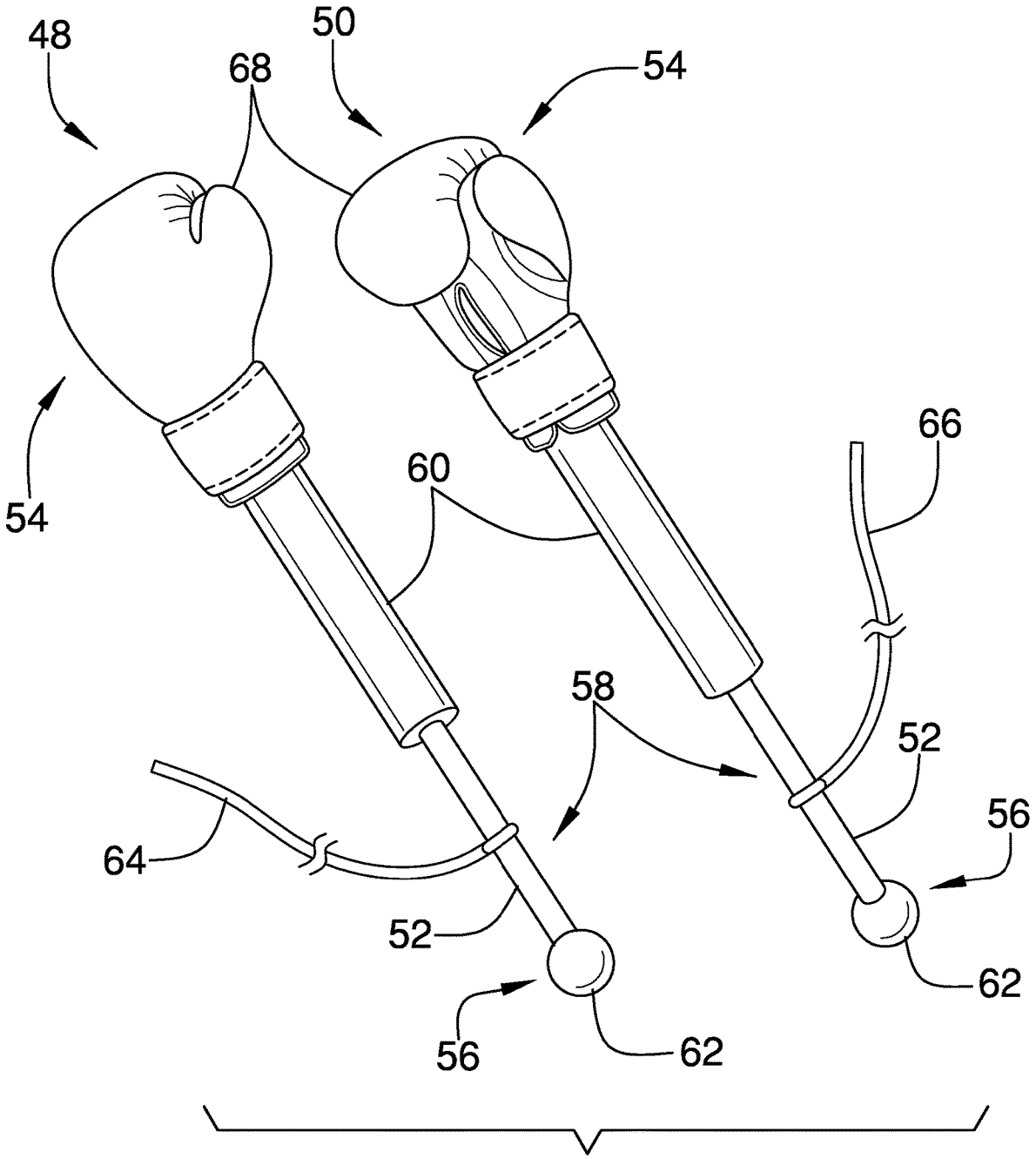
FIG. 7 is an isometric view of an embodiment of the disclosure.
Figure 8:
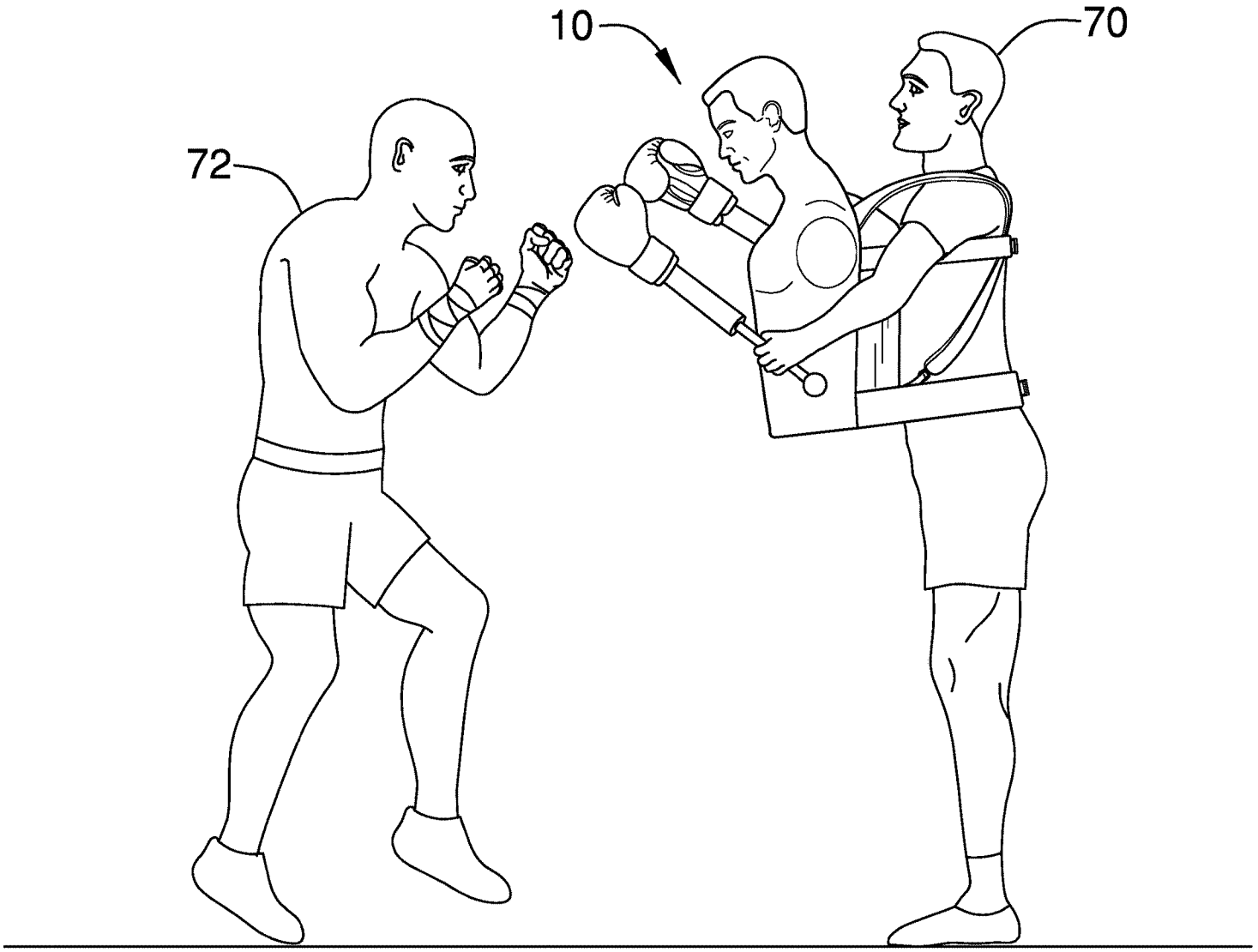
FIG. 8 is an in-use view of an embodiment of the disclosure.

A padding member 60 is coupled to the pole 52. The padding member 60 extends partially along the pole 52 from the boxing glove 68 toward the gripping portion 58. As shown in FIG. 7, the padding member 68 may not extend along the entire length of the pole 52, leaving some of the pole 52 exposed at the gripping portion 58 to facilitate the user 70 in holding the pole 52.

The pole 52 may also have a weighted end 56. The weighted end 56 is generally on the opposite end of the pole 52 from the glove portion 54 and boxing glove 68. In some embodiments, a counterweight 62 is coupled to the weighted end 56. The counterweight 62 may be permanently affixed to the weighted end 56. In other embodiments, the counterweight 62 may be removably coupled to the weighted end 56. In those embodiments, the counterweight 62 may be interchangeable or adjustable to change the weight of the counterweight 62. For example, some embodiments of the counterweight 62 may be less than 1.0 pound. Other embodiments of the counterweight 62 may be greater than 1.0 pound, for example because the user 70 wants more strenuous exercise while using the first 48 and second 50 arm rods.

Figure 9:
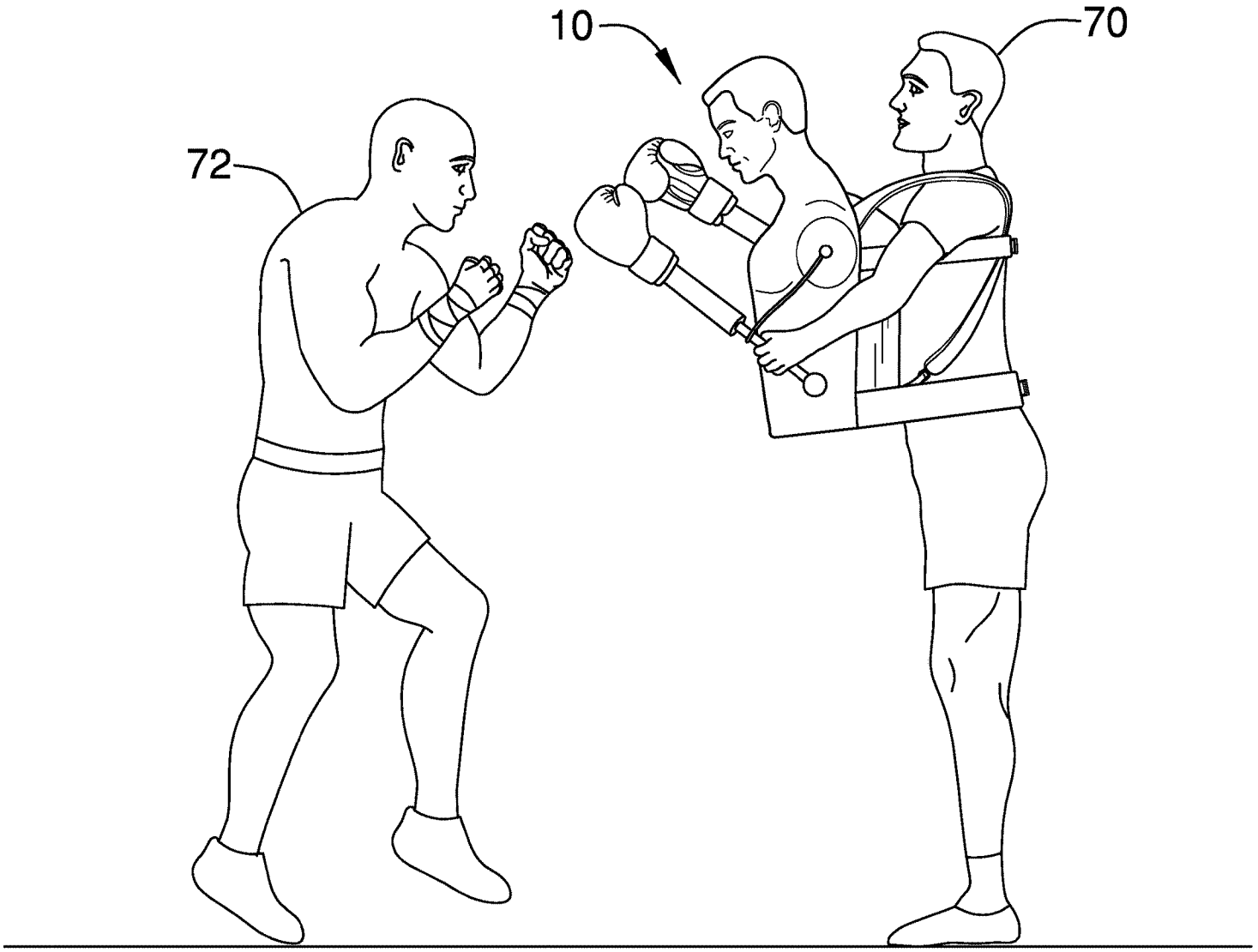
FIG. 9 is an in-use view of an embodiment of the disclosure.
Figure 10:
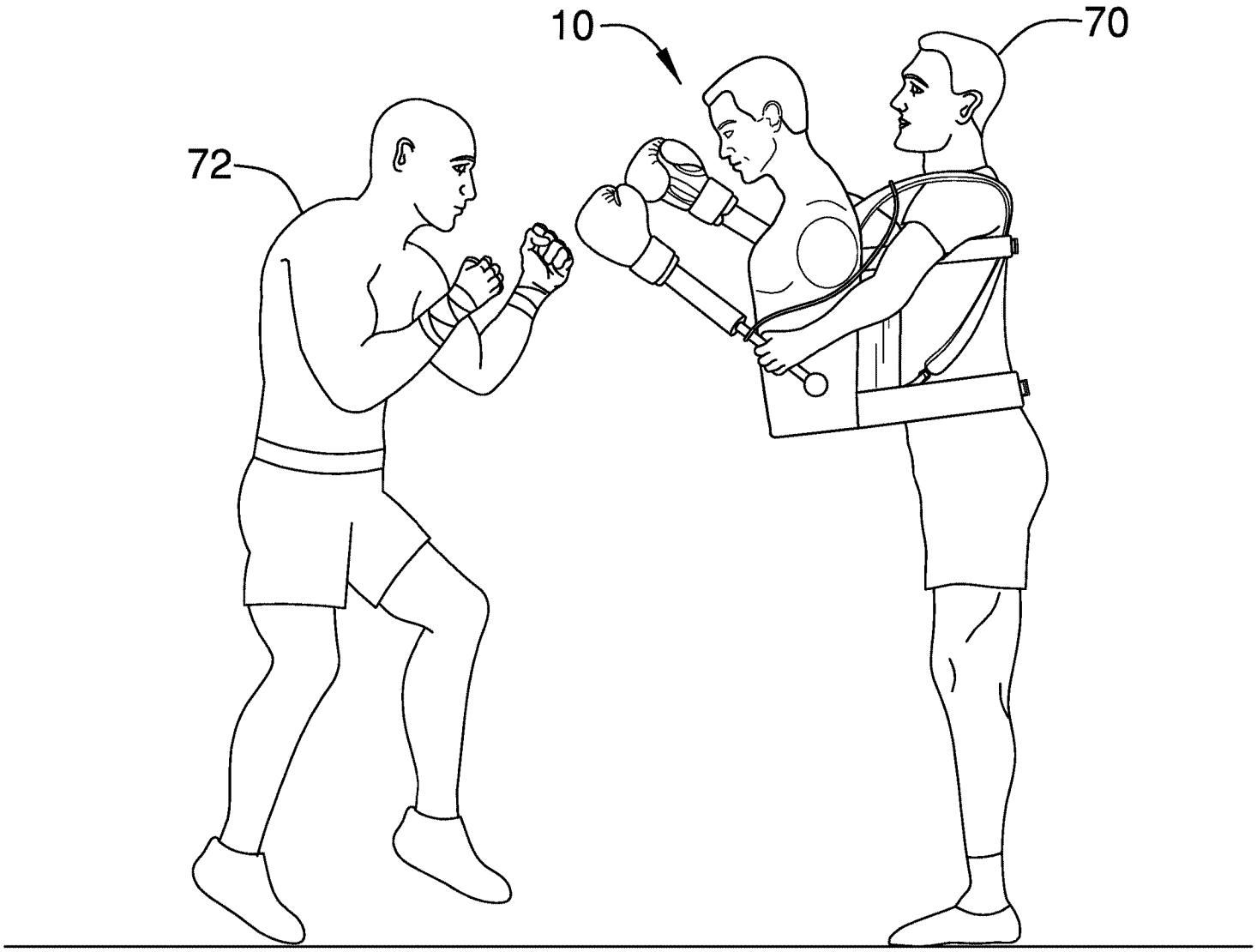
FIG. 10 is an in-use view of an embodiment of the disclosure.

In some embodiments, the first 48 and second 50 arm rods are removably attached to the dummy 12 or the harness 34. For example, the arm rods 48, 50 may be removably attached to the torso portion 26 or to the shoulder straps 42, 44. A first cord 64 removably attaches the first arm rod 48 to the torso portion 26 or to the first shoulder strap 42. A second cord 66 removably attaches the second arm rod 50 to the torso portion 26 or to the second shoulder strap 44. FIG. 9 shows an embodiment with the first 48 and second 50 arm rods attached to the torso portion 26. FIG. 10 shows an embodiment with the first 48 and second 50 arm rods attached to the first 42 and second 44 shoulder straps.

Figure 11:
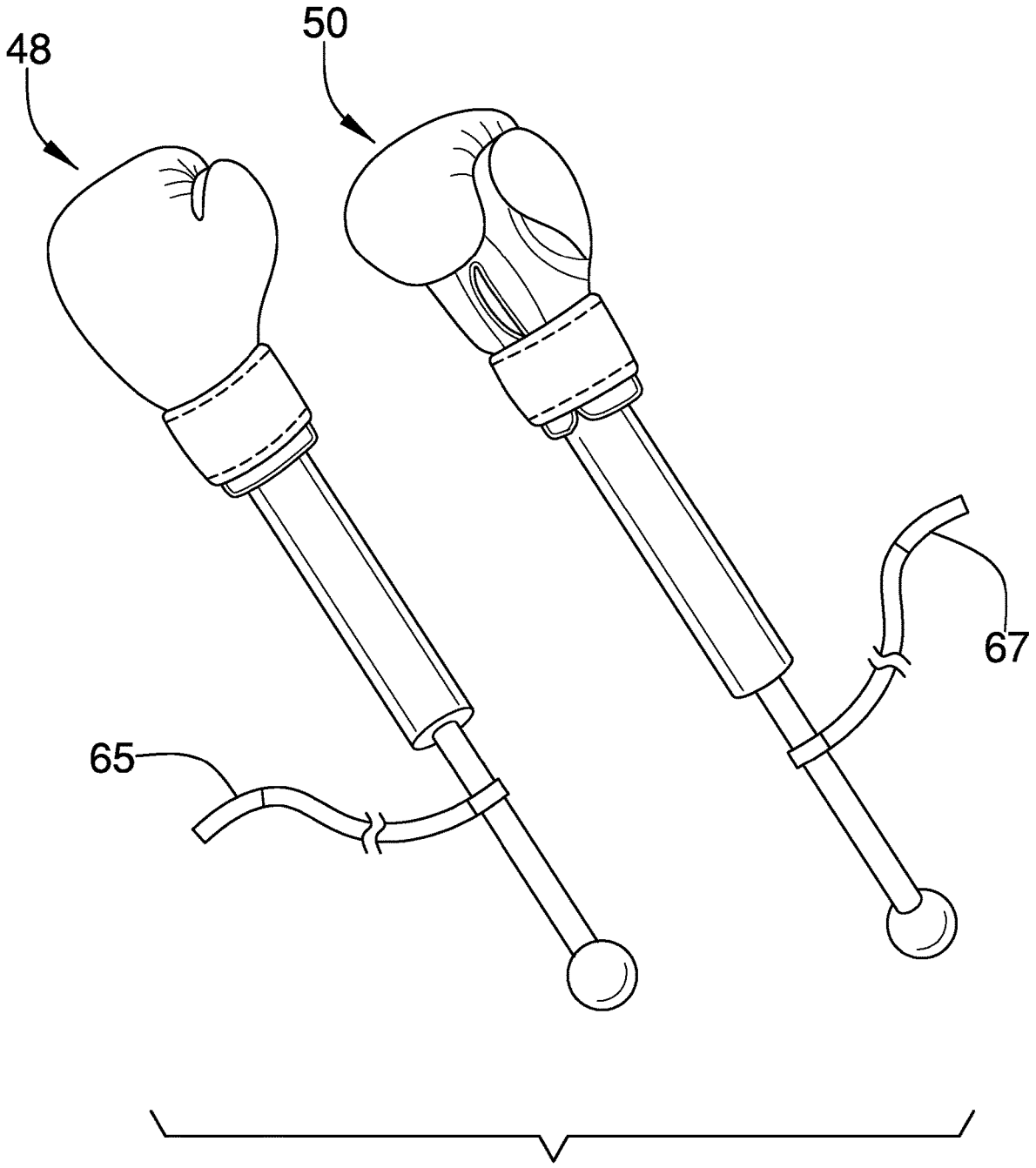
FIG. 11 is an isometric view of an embodiment of the disclosure.
Figure 12:
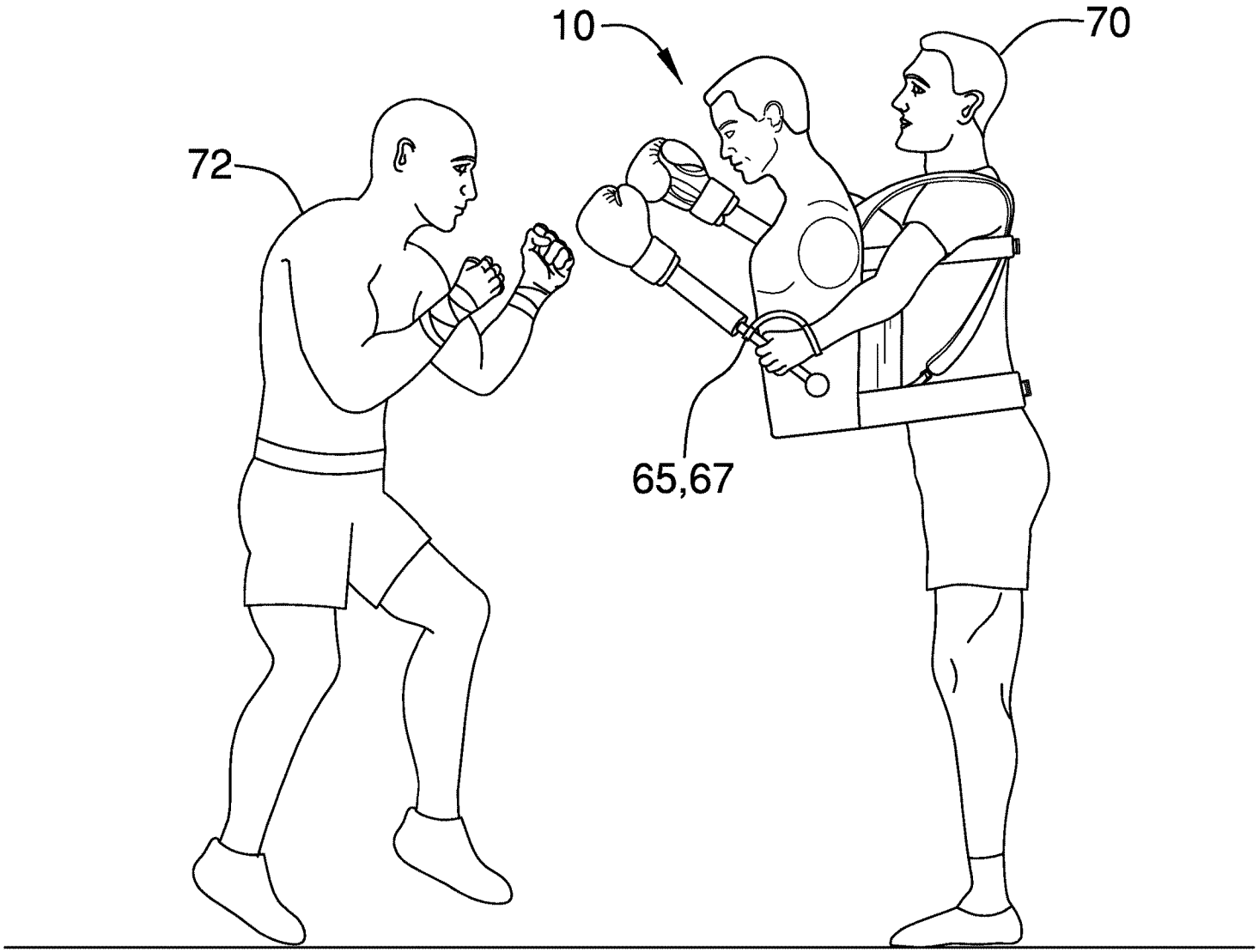
FIG. 12 is an in-use view of an embodiment of the disclosure.

In some embodiments, the first 48 and second 50 arm rods are removably attached to the user 70. For example, the arm rods 48, 50 may be removably attachable to the wrists of the user 70. A first wrist strap 65 removably attaches the first arm rod 48 to a first wrist of the user 70. A second wrist strap 67 removably attaches the second arm rod 50 to a second wrist of the user 70. FIG. 11 shows an embodiment with the first 65 and second 67 wrist straps coupled to the first 48 and second 50 arm rods, respectively. FIG. 12 shows an in-use view, with the first 48 and second 50 arm rods attached to the wrists of the user by the first 65 and second 67 wrist straps. The wrist straps may be helpful in relieving the pressure or weight of the arm rods 48, 50 on the arms of the user 70, particularly when the counterweight 62 and boxing glove 68 are coupled to the arm rods 48, 50. The first 65 and second 67 wrist straps may be shorter than the first 64 and second 66 cords because the first 65 and second 67 wrist straps only extend between the first 48 and second 50 arm rods, rather than extending up toward the torso portion 26 or the first 42 and second 44 shoulder straps.

In use, the user 70 can wear the portable sparring mannequin device 10 to safely imitate a real fight with the trainee 72. The user 70 can bob, weave, and move around to avoid the trainee's 72 blows while throwing practice blows at the trainee 72 using the first 48 and second 50 arm rods. The trainee 72 is therefore given the opportunity to practice footwork, offense, and defense as if engaged in a real fight. The padding and cushioning on the portable sparring mannequin device 10 help reduce the risk of injury to both the user 70 and the trainee 72 during these practice fights.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A portable sparring mannequin comprising:

a dummy having a front side, a back side, a top, and a bottom, the dummy including:

a head portion at the top;

a neck portion extending downwardly from the head portion;

a torso portion, the torso portion extending downwardly from the neck portion, the neck portion connecting the head portion to the torso portion;

a cushioning panel being attached to the back side;

a harness being coupled to the torso portion for releasably attaching the dummy to a user;

the neck portion being angled forwardly such that the head portion is positioned forwardly relative to the torso portion, the head portion being spaced from the harness; and a first arm rod and a second arm rod being removably attached to the harness, each of the first and second arm rods comprising:

a pole having a glove portion and a gripping portion;

a boxing glove being removably attached to the glove portion; and a padding member being coupled to the pole, the padding member extending partially along the pole from the boxing glove toward the gripping portion.

2. The portable sparring mannequin of claim 1, the cushioning panel further comprising multiple layers, each of the layers having a different resistance to compression with respect to each other.

3. The portable sparring mannequin of claim 2, wherein a layer closest to the dummy is more resistant to compression than a layer positioned farthest from the dummy.

4. The portable sparring mannequin of claim 1, wherein the harness is padded.

5. The portable sparring mannequin of claim 1, the harness further comprising a plurality of straps having adjustable lengths and being releasably coupled to each other.

6. The portable sparring mannequin of claim 1, further comprising a counterweight being removably coupled to the gripping portion.

7. The portable sparring mannequin of claim 1, further comprising a first cord removably attaching the first arm rod to the harness and a second cord removably attaching the second arm rod to the harness.

8. The portable sparring mannequin of claim 1, further comprising a first wrist strap being removably connectable to the first arm rod and a second wrist strap being removably connectable to the second arm rod, wherein the first wrist strap and the second wrist strap are configured to removably attach to a first wrist and a second wrist of the user.

9. The portable sparring mannequin of claim 1, wherein the head portion is spaced vertically and forwardly from the harness.

10. A portable sparring mannequin comprising:

a dummy having a front side, a back side, a top, and a bottom, the dummy including:

a head portion at the top;

a neck portion extending downwardly from the head portion;

a torso portion, the torso portion extending downwardly from the neck portion, the neck portion connecting the head portion to the torso portion;

a cushioning panel being attached to the back side;

a harness being coupled to the torso portion for releasably attaching the dummy to a user, the harness further comprising a plurality of straps having adjustable lengths and being releasably coupled to each other;

the neck portion being angled forwardly such that the head portion is positioned forwardly relative to the torso portion, the head portion being spaced from the harness; and the plurality of straps further comprising:

a chest strap being configured to receive a chest of the user, the chest strap extending horizontally across the back side;

a waist strap being configured to receive a waist of the user, the waist strap extending horizontally across the back side, the waist strap being below the chest strap; and a first shoulder strap and a second shoulder strap being configured to receive a first shoulder and a second shoulder of the user, the first shoulder strap and the second shoulder strap extending vertically across the back side, the first shoulder strap and the second shoulder strap crossing over each other.

11. A portable sparring mannequin comprising:

a dummy having a front side, a back side, a top, and a bottom, the dummy including:

a head portion at the top;

a neck portion extending downwardly from the head portion;

a torso portion, the torso portion extending downwardly from the neck portion, the neck portion connecting the head portion to the torso portion;

a cushioning panel being attached to the back side, the cushioning panel protruding from the torso portion, the cushioning panel having multiple layers, each of the layers having a different resistance to compression with respect to each other, a layer closest to the dummy being more resistant to compression than a layer positioned farthest from the dummy;

a harness being coupled to the torso portion for releasably attaching the dummy to a user, the harness being padded, the harness comprising:

a plurality of straps having adjustable lengths and being releasably coupled to each other, the plurality of straps including:

a chest strap extending horizontally across the back side, the chest strap being configured to receive a chest of the user;

a waist strap extending horizontally across the back side below the chest strap, the waist strap being configured to receive a waist of the user;

a first shoulder strap and a second shoulder strap extending vertically across the back side, the first shoulder strap and the second shoulder strap crossing over each other between the chest strap and the waist strap, the first shoulder strap and the second shoulder strap being configured to receive a first shoulder and a second shoulder of the user;

the neck portion being angled forwardly such that the head portion is positioned forwardly relative to the torso portion, the head portion being spaced a distance from the harness, the distance being more than 12 inches;

a first arm rod and a second arm rod being removably attached to the torso portion, each of the first and second arm rods comprising:

a pole having a glove end and a weighted end;

a boxing glove being removably attached to the glove end;

a padding member being coupled to the pole, the padding member extending partially along the pole from the boxing glove toward the weighted end;

a counterweight being removably coupled to the weighted end;

a gripping portion extending between the padding member and the counterweight;

a first cord removably attaching the first arm rod to the torso portion; and a second cord removably attaching the second arm rod to the torso portion.

* * * * *